United States Patent [19]

Saccomanno

[11] 4,450,595

[45] May 29, 1984

[54] WATER SAVING LIQUID WASTE DISPOSAL SYSTEM FOR USE WITH A WATER CLOSET OR THE LIKE

[76] Inventor: Geno Saccomanno, 778 26½ Rd., Grand Junction, Colo. 81501

[21] Appl. No.: 426,718

[22] Filed: Sep. 29, 1982

[51] Int. Cl.³ ..... E03D 13/00

[52] U.S. Cl. ..... 4/301; 4/144.1; 4/340; 4/415; 4/661

[58] Field of Search ..... 4/415, 213, 144.1, 340, 4/301, 341, 661

[56] References Cited

U.S. PATENT DOCUMENTS

| | | | |
|---|---|---|---|
| 1,607,257 | 11/1926 | Gaulke | 4/340 |
| 1,612,665 | 12/1926 | Tivoli | 4/445 |
| 3,336,602 | 8/1967 | Kubit | 4/341 |
| 3,822,419 | 7/1974 | Wilson, Sr. | 4/301 |
| 4,094,023 | 6/1978 | Smith | 4/213 |
| 4,145,768 | 3/1979 | Chevrette | 4/144.1 |
| 4,197,598 | 4/1980 | Lemmon | 4/341 X |
| 4,282,611 | 8/1981 | O'Day | 4/144.1 |
| 4,285,077 | 8/1981 | Braxton | 4/144.1 X |
| 4,375,704 | 3/1983 | Smith | 4/213 |

FOREIGN PATENT DOCUMENTS

| | | | |
|---|---|---|---|
| 1013782 | 8/1952 | France | 4/445 |

*Primary Examiner*—Henry K. Artis

[57] ABSTRACT

A liquid waste disposal system for use with a water closet or the like communicating through a trap to a sewer line comprising a plate mounted within the water closet bowl, a duct extending from said plate, around the trap and to the sewer line, and means for orienting said plate such that the shape and orientation of the plate causes a liquid falling onto the plate to flow into the duct and directly to the sewer line.

13 Claims, 3 Drawing Figures

WATER SAVING LIQUID WASTE DISPOSAL SYSTEM FOR USE WITH A WATER CLOSET OR THE LIKE

BACKGROUND OF THE INVENTION

The present invention relates to a water saving liquid waste disposal system for use with a water closet or the like. The system may be utilized with the water closet such that liquid waste is disposed into a sewer line connected with the water closet without any need for flushing the water closet or otherwise utilizing water supplying the water closet. Thus, the invention provides an efficient means of disposing of liquid waste, especially human urine, without unnecessarily using clean water.

A patentability search was conducted for the present invention and the following patents were uncovered:

| U.S. Pat. No. | Inventor | Issue Date |
|---|---|---|
| 681,541 | Gosieniecki | Aug. 27, 1901 |
| 1,056,361 | Podmore | Mar. 18, 1913 |
| 3,336,602 | Kubit | Aug. 22, 1967 |
| 3,412,408 | Michal | Nov. 26, 1968 |
| 3,625,654 | Van Duyne | May 22, 1970 |
| 4,197,598 | Lemmon | Apr. 15, 1980 |

The Lemmon patent and the Kubit patent each disclose a water closet bowl partitioned into a main bowl section and a smaller urinal bowl section, the urinal bowl section being adapted to receive liquid waste only. The urinal bowl section may be flushed independently of the main bowl section.

The Michal patent pertains to a urinal attachment for conventional toilet bowls. The urinal attachment comprises a flexible tube-like disposable drain duct provided with a collar on one end thereof. The urinal attachment is mounted on the toilet bowl such that the end of the drain duct provided with the collar is outside the toilet bowl and positioned at a height convenient for males to urinate into the drain duct while standing. The other end of the drain duct is disposed in the toilet bowl. Various means are described for flushing of the urinal attachment.

The Van Duyne patent discloses a cup-shaped device provided with a handle adapted for removable attachment to the rim of a toilet bowl. The device is utilized for collecting urine specimens to be used in urinalysis.

The Podmore patent relates to a water closet having a water bowl partitioned into a main bowl section and a smaller urinal bowl section. The flushing of both bowl sections is accomplished simultaneously.

The Gosieniecki patent relates to a bowl-shaped receptacle mounted on the side of a conventional water closet bowl which may be utilized as a cuspidor. The receptacle freely communicates with the water closet bowl interior and has a depth below the normal water line in the water closet bowl so that flushing of the water closet bowl automatically flushes the receptacle.

SUMMARY OF THE INVENTION

A liquid waste disposal system for use with a water closet or the like communicating through a trap to a sewer line comprises a plate mounted within the water closet bowl, a duct extending from said plate, around the trap and to the sewer line, and means for orienting said plate such that the shape and orientation of the plate causes a liquid falling onto the plate to flow into the duct and directly to the sewer line.

BRIEF DESCRIPTION OF THE DRAWINGS

The invention will be described with reference to the accompanying drawings, wherein.

DESCRIPTION OF A PREFERRED EMBODIMENT

Figure 1:
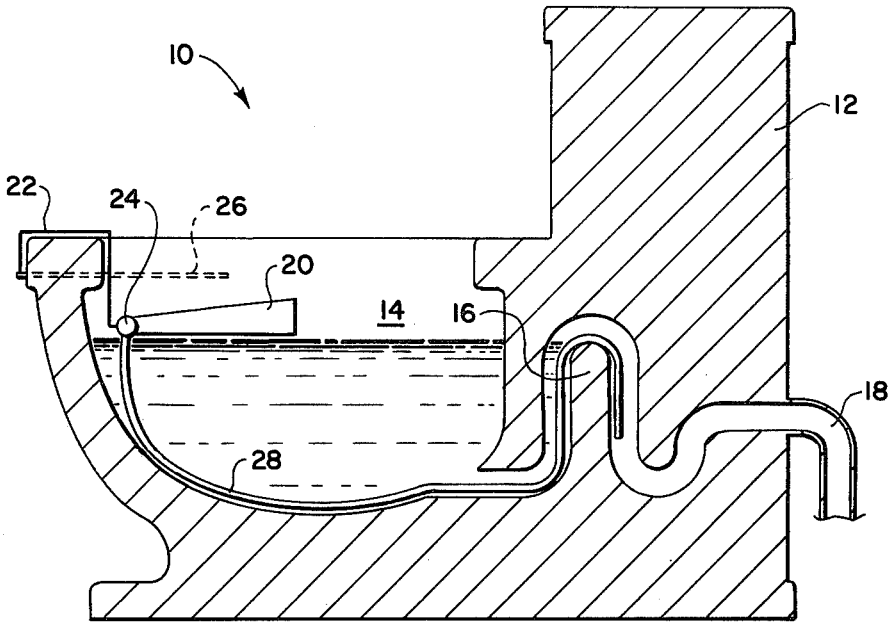
FIG. 1 is a cross-sectional view of a conventional water closet depicting a liquid waste disposal system in accordance with one embodiment of the present invention.
Figure 3:
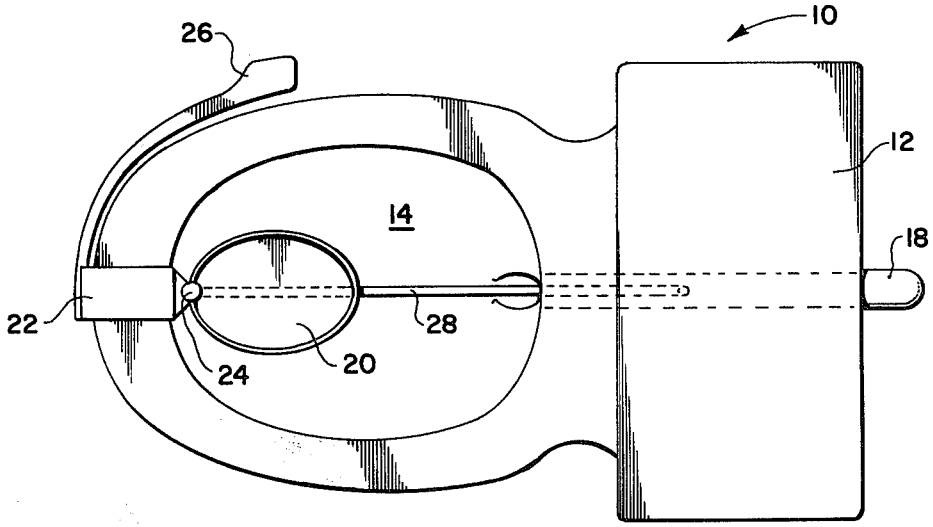
FIG. 3 is a top view of the water closet and system shown in FIG. 1.

Referring now to the drawings wherein like reference numerals and symbols refer to the same item, there is shown in FIGS. 1 and 3 a conventional water closet 10. The water closet 10 includes a relatively high positioned water tank 12 for containing water and which is connected through piping (not shown) to a suitable source of water. The water closet 10 also includes a bowl 14 normally partially filled with water for receiving human waste. The water closet bowl 14 communicates through a conventional trap 16 to a sewer line 18. To discharge water and waste within the water closet bowl 14 to the sewer line 18, the water closet 10 is flushed in a well-known manner whereby water within the water tank 12 flows into the water closet bowl 14, thereby displacing the water and waste within the bowl 14 through the trap 16 and into the sewer line 18. This flushing operation may be accomplished since, in accordance with a well understood principle of physics, whenever the water line of the liquid within the water closet bowl 14 is above the height of the trap 16, the liquid will flow from the bowl 14, through the trap 16, and to the sewer line 18. Thus, the water line in the water closet bowl 14 normally will approximate the height of the trap 16.

As will be more fully appreciated later herein, it should be understood that the present invention may be utilized with devices similar in function and operation to that of a water closet, such as urinals.

A device that may be used in connection with the system of the present invention will now be described. The device includes a generally oval shaped plate 20 that is removably mounted within the water closet bowl 14 by any suitable means such as a wire hanger 22 resting upon and clasping about the rim of the water closet bowl 14. Preferably, both the wire hanger 22 and the plate 20 are interconnected through an angle ball valve 24. The plate 20 preferably rotates through a horizontal axis extending through the angle ball valve 24. Rotation of the plate 20 from a position where it is disposed in the water closet bowl 14 above the normal water line within the bowl 14 to a position, as depicted in FIG. 2, where the plate 20 is substantially submerged in the water normally contained in the water closet bowl 14 may be accomplished by movement of a lever arm 26 or the like through suitable mechanical or hydraulic linkage (not shown) well-known to those skilled in the art.

The angle ball valve 24 is connected to a flexible duct or tube 28 that extends along the bottom of the water closet bowl 14 and up and around the trap 16.

The plate 20 is so oriented within the water closet bowl 14 and the upper surface of the plate 20 is so shaped, that when the plate 20 is maintained in the position shown in FIG. 1, where it is above the water line in the water closet bowl 14, any liquid, such as human urine, impinging upon the plate 20, will automatically flow toward the angle ball valve 24. When the plate 20 is so disposed, the angle ball valve 24 is in an open position such that the liquid impinging upon the plate 20 will flow through the angle ball valve 24, into the duct 28, and into the sewer line 18, all without flushing of the water closet 10 or otherwise utilizing water supplying the water closet 10.

Figure 2:
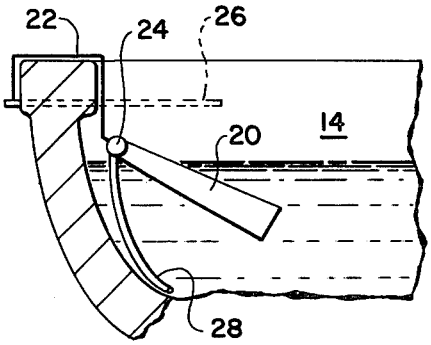
FIG. 2 is a sectional view of the water closet and system shown in FIG. 1, with the plate portion of the system rotated about a horizontal axis to a position whereby a substantial portion of the plate is submerged in the water normally contained within the water closet bowl.

When there is no anticipation of liquid impinging upon the plate 20, the plate 20 may be rotated into the position shown in FIG. 2, where it is substantially submerged in the water in the water closet bowl 14. Such position of the plate 20 permits the water closet 10 to be used in its usual manner for the disposal of either liquid or solid human waste. Also, in this position, the angle ball valve 24 is in a closed position so that no odors from within the sewer line 18 or from within the duct 28 are permitted to escape to the air surrounding the water closet 10.

When it is anticipated that the device will be used to dispose of liquid waste, the plate 20 will be rotated once again to the position shown in FIG. 1. During this rotation, the upper surface of the plate 20 will be cleansed by its forceful contact with and movement through the water within the water closet bowl 14. Also, in this connection, it is preferred that the rear portion of the plate 20 be thicker than the front portion of the plate 20, whereby rotation of the plate will cause a rush of water away from the front of the water closet bowl 14. Such a rush of water serves to transport debris such as toilet paper away from the front portion of the plate 20 and the angle ball valve 24, wich otherwise might cause interference with the operation of the device.

Obviously, the device just described is the preferred device, and there are a number of similar devices which fall within the scope of the present invention. For example, the plate 20 may be mounted on the water closet 10 in a variety of locations; the plate 20 may have a variety of shapes and configurations; the angle ball valve 24 may be omitted entirely, or the flexible tube 28 may be removably disposed in the water closet 10, may be sealed in the water closet 10 or may comprise a conduit formed integrally within the water closet 10, etc.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than as specifically described above.

I claim:

1. A liquid waste disposal system for use with a water closet communicating with a source of water for flushing the same and communicating through a trap to a sewer line comprising:

a plate positioned within the water closet bowl for receiving and collecting a liquid, said plate being shaped and positioned such that a liquid impinging upon the plate is received and collected by the plate and caused to flow toward a relatively small area of the plate;

means for positioning said liquid receiving and collecting means in the vicinity of the water closet; and means for transporting liquid received and collected by the plate directly to the sewer line substantially without the liquid contacting water from the water source.

2. A liquid waste disposal system according to claim 1 wherein said transporting means comprises a duct communicating with said receiving and collecting means and with the sewer line.

3. A liquid waste disposal system according to claim 2 wherein the duct is formed substantially integrally with the water closet.

4. A liquid waste disposal system according to claim 2 wherein the duct comprises a substantially flexible tube extending through the bowl of the water closet and through the trap.

5. A liquid waste disposal system according to claim 1 wherein said transporting means comprises a duct communicating with the relatively small area of the plate and with the sewer line.

6. A liquid waste disposal system according to claim 1 wherein the plate is rotatable about a substantially horizontal axis.

7. A liquid waste disposal system according to claim 6 further comprising means for selectively maintaining the plate in either of at least two positions of rotation.

8. A liquid waste disposal system according to claim 6 wherein the plate is rotatable from a position whereat the plate is substantially above the normal water line of a liquid contained in the water closet bowl to a position whereat the plate is substantially below such normal water line.

9. A liquid waste disposal system according to claim 8 wherein the plate is shaped and oriented such that when the plate is in a position substantially above such normal water line a liquid impinging upon the plate is received and collected by the plate and caused to flow toward a relatively small area of the plate, and wherein the transporting means comprises a duct and an angle ball valve communicating with the duct and positioned near the relatively small area of the plate, and wherein liquid flowing to the relatively small area of the plate will flow through the angle ball valve and into the duct when the plate is substantially above such normal water line but will not flow through the angle ball valve and into the duct when the plate is substantially below such normal water line.

10. A liquid waste disposal system according to claim 8 wherein the plate is positioned near the front of the water closet bowl, wherein the horizontal axis is located forwardly of the middle of the plate, and wherein the back of the plate is substantially thicker than the front of the plate.

11. A liquid waste disposal system for use with a water closet communicating through a trap to a sewer line comprising;

a plate adapted for removable mounting on the water closet;

a duct extending from said plate, through the bowl of the water closet, through the trap, and to the sewer line; and means for orienting said plate within the water closet bowl such that the shape and orientation of the plate causes a liquid falling onto the plate to flow into the duct and to the sewer line.

12. A process of liquid waste disposal comprising the steps of:

providing a water closet communicating with a source of water for flushing the same and communicating through a trap to a sewer line;

providing a plate;

providing a duct;

removably positioning the plate within the water closet bowl;

positioning the duct such that the duct extends from the plate, through the water closet bowl, through the trap, and to the sewer line;

positioning the plate and the duct such that a liquid deposited on the plate flows into the duct and directly to the sewer line substantially without the liquid contacting water from the water source; and depositing a liquid on the plate.

13. A liquid waste disposal system according to claim 11 wherein the plate is positioned within the water closet bowl and wherein the plate is shaped and positioned such that a liquid impinging upon the plate is received and collected by the plate and caused to flow toward a relatively small area of the plate.

* * * * *